United States Patent [19]

Karam et al.

[11] 3,954,464

[45] May 4, 1976

[54] METHOD OF FABRICATING A COMPOSITE TRIGONAL SELENIUM PHOTORECEPTOR

[75] Inventors: Ronald E. Karam, Webster; Richard P. Millonzi, Marion, both of N.Y.

[73] Assignee: Xerox Corporation, Stamford, Conn.

[22] Filed: May 28, 1974

[21] Appl. No.: 473,859

[52] U.S. Cl. ..... 96/1.5; 428/538

[51] Int. Cl.[2] ..... G03G 5/04

[58] Field of Search ..... 96/1, 1.5; 428/538; 427/124

[56] References Cited

UNITED STATES PATENTS

| | | | |
|---|---|---|---|
| 2,476,042 | 7/1949 | Hewlett | 96/1.5 |
| 2,739,079 | 3/1956 | Keck | 96/1.5 |
| 2,753,278 | 7/1956 | Bixby et al. | 96/1.5 |

FOREIGN PATENTS OR APPLICATIONS

| | | | |
|---|---|---|---|
| 16,198 | 7/1968 | Japan | 96/1.5 |

*Primary Examiner*—David Klein
*Assistant Examiner*—John L. Goodrow
*Attorney, Agent, or Firm*—James J. Ralabate; James P. O'Sullivan; Jerome L. Jeffers

[57] ABSTRACT

A method of making a photosensitive imaging device which comprises; vacuum evaporating a thin layer of vitreous selenium over a layer of electrically active organic material which is contained on a supporting substrate, forming a relatively thin layer of electrically insulating or electrically active organic material over said selenium layer, followed by heating said device to an elevated temperature for a time sufficient to convert the vitreous selenium to the crystalline trigonal form. The imaging device is also disclosed.

5 Claims, 1 Drawing Figure

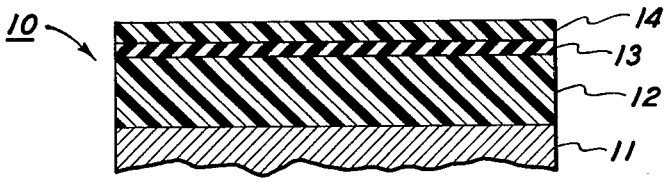
10
14
13
12
11

METHOD OF FABRICATING A COMPOSITE TRIGONAL SELENIUM PHOTORECEPTOR

BACKGROUND OF THE INVENTION

This invention relates in general to xerography and more specifically to a method of making a photosensitive device.

In the art of xerography, a xerographic plate containing a photoconductive insulating layer is first uniformly electrostatically charged in the dark in order to sensitize the surface of the photoconductive layer. The plate is then exposed to an image of activating electromagnetic radiation, such as light, which selectively dissipates the charge in the illuminated areas of the photoconductive insulator while leaving behind the latent electrostatic image in the nonilluminated areas. The latent electrostatic image may be developed and made visible by depositing finely divided electroscopic marking particles on the surface of the photoconductive layer. This concept was originally described by Carlson in U.S. Pat. No. 2,297,691 and is further amplified and described by many related patents in the field.

Conventional xerographic plates or drums usually comprise a photoconductive insulating layer overlaying a conductive support. A photoconductive material which has had wide use as a reusable photoconductor in commercial xerography comprises vitreous or amorphous selenium. Vitreous selenium in essence comprises super cooled selenium liquid and may readily be formed by vacuum evaporation by cooling the liquid or vapor so suddenly that crystals of selenium do not have time to form. Although vitreous selenium has had wide acceptance for commercial use in xerography, its spectral response is limited largely to the blue-green portion of the electromagnetic spectrum (below about 5200 Angstrom Units). In general, one requirement of a photoconductor, such as vitreous selenium, is that its resistivity should drop at least several orders of magnitude in the presence of activating radiation or light. Also, the photoconductive layer should be able to support an electrical potential of at least about 100 volts in the absence of radiation.

Selenium also exists in a crystalline form known as trigonal or hexagonal selenium which is well known to the semiconductor art for use in the manufacture of selenium rectifiers. In the crystalline trigonal form, the structure of the selenium consists of helical chains of selenium atoms which are parallel to each other along the crystallographic *c*-axis. Trigonal selenium is not normally used in xerography as a homogeneous photoconductive layer because of its relatively high electrical conductivity in the dark, although in some instances trigonal selenium can be used in binder structures wherein trigonal selenium particles are dispersed in a matrix of another material such as an electrically active organic material, or a photoconductor such as vitreous selenium.

U.S. Pat. Nos. 2,739,079 and 3,692,521 both describe photosensitive members utilizing small amounts of crystalline hexagonal (trigonal) selenium contained in predominantly vitreous selenium matrices. In addition, copending U.S. Pat. application Ser. No. 669,915, filed Sept. 22, 1967, describes a special form of red-hexagonal selenium suitable for use in binder structure in which finely divided red-hexagonal selenium particles are contained in a resin binder matrix.

Although trigonal selenium exhibits a wider spectral response than vitreous selenium, as stated above, trigonal selenium is not normally used in xerography because of its relatively high electrical conductivity in the dark. However, imaging structures which are able to use a homogeneous layer of hexagonal selenium would have advantages over those using vitreous selenium with regard to improved spectral response and increased sensitivity. Further, the use of a trigonal selenium layer in a specially constructed xerographic member could provide better overall electrical characteristics than vitreous selenium photoreceptors.

OBJECTS OF THE INVENTION

It is therefore an object of this invention to provide a method of making an imaging device.

It is another object of this invention to provide a method of making an imaging device which has a photoinjecting layer of crystalline trigonal selenium.

It is yet another object of this invention to provide a photosensitive device suitable for imaging in the xerographic mode.

It is a further object of this invention to provide an imaging member which exhibits a panchromatic response and excellent mechanical flexibility.

SUMMARY OF THE INVENTION

The invention is directed to a method of preparing an imaging member and to the imaging member itself which comprises a thin layer of crystalline trigonal selenium overlaying a layer of electrically active transport material which is contained on a supporting substrate. The trigonal selenium layer is further overcoated with a thin protective layer of electrically active transport material. The process of making the device comprises vacuum evaporating a thin amorphous selenium layer of the required thickness over a layer of the electrically active transport material which is contained on a supporting substrate. The amorphous selenium layer is then coated with a very thin top layer of electrically active material. This top layer prevents the vaporization of the selenium during the subsequent thermal treatment. Alternatively, this top layer may also comprise an electrically insulating material. The amorphous selenium layer is then transformed to the crystalline trigonal form in situ by heat treating the device under critically controlled conditions resulting in the transformation of the amorphous selenium to the crystalline trigonal form.

The above device or imaging member is suitable for use in a xerographic-type imaging system in which the free surface of the thin top active layer is uniformly charged to a positive potential and then exposed to radiation to which the electrically active transport layer is substantially nonabsorbant or transparent, and to which the photoconductive trigonal selenium layer is substantially absorbing. Positive electrical charges or "holes" generated by the trigonal selenium layer are injected into the transport layer and moved to selectively discharge the device, resulting in the formation of a latent electrostatic image on the thin top active layer. This latent image may then be later developed to form a visible image.

DETAILED DESCRIPTION OF THE INVENTION

The trigonal selenium layers of the present invention are used in a composite imaging member suitable for use in xerographic type imaging. The FIGURE in the drawing illustrates a suitable imaging device for such a trigonal selenium layer.

In the figure, reference character 10 illustrates an imaging member comprising a supporting substrate 11 overlayed with a charge transport layer of electrically active material 12 which is covered with a thin layer of crystalline trigonal selenium 13. A thin top layer of electrically active material 14 overlays the trigonal selenium layer. The imaging member may be in any form such as a flat plate, drum or cylinder, drum scroll or a flexible endless belt.

The substrate 11 is preferably made up of any suitable conductive material. Typical conductors comprise aluminum, steel, brass, conducting polymers or the like. The substrate may be rigid or flexible and of any convenient thickness. The substrate may also comprise a composite structure such as a thin conductive coating contained on a paper base; a plastic coated with a thin conductive layer such as aluminum or copper iodide; or glass coated with a thin conductive coating of chromium or tin oxide. If desired, the substrate may also be a substantial dielectric or electrically insulating material and the device charged by techniques well known to the art of xerography when using imaging members having electrically insulating substrates.

In general, charge transport layer 12 may comprise any suitable electrically active organic polymer or nonpolymeric material capable of supporting the injection of photoexcited holes from the photoconductive layer and allowing the transport of these holes through the organic layer to selectively discharge the imaging member. Typical polymers include poly-n-vinylcarbazole (PVK), poly-1-vinylpyrene (PVP), poly-9-vinylanthracene and others. Typical nonpolymeric materials include carbazole, pyrene, tetra phenyl pyrene, benzochrysene, perylene, tetracene, pycene, fluorene, fluorenone and naphthalene. A larger group of suitable materials for use in layer 13 are more fully described in copending application Ser. No. 371,647, filed on June 20, 1973, which are incorporated herein by reference.

Alternatively, an electron transport material may also be used for layer 12. A typical electron transport material comprises, 2,4,7-trinitro-9-fluorenone (TNF). The TNF may be used alone or in combination with relatively electrically inactive organic materials such as polyesters or complexed with other active materials such as polyvinyl carbazole.

In general, the thickness of the active transport layer 12 should be from about 5 to 100 microns, but thicknesses outside this range can also be used. A thickness range from about 5 to 25 microns has been found particularly satisfactory.

Trigonal selenium layer 13 is formed by the techniques already described and must be maintained in a critical thickness range of about 0.03 to 0.8 microns in order for the device to function effectively. Thicknesses below about 0.03 microns do not absorb sufficient amounts of light and, therefore, do not generate sufficient numbers of electrical charges, while thicknesses about 0.8 microns result in an excessively high dark conductivity and the plate will not function adequately to be useful in imaging.

Protective top layer or coating 14 preferably comprises an electrically active organic material of the type described above for active layer 12. In a given device it may comprise the same material as that used for layer 12 or a different active material. The thickness of layer 14 is relatively thin with a thickness of about 0.05 to 2 microns being satisfactory. In an alternative embodiment, layer 14 may also comprise an electrically insulating resin or polymer. Typical materials include polyesters, polyurethanes, polycarbonates, polyamides, polyvinyl chlorides, commercial waxes, acrylics and epoxies.

In imaging the above device, the free surface of the top layer 14 of active material is uniformly electrostatically charged to a given potential. The device is then exposed to a pattern of activating radiation of any suitable wavelength such that the layer 14 is substantially nonabsorbing or transparent to the imaging light. This light generates electronhole pairs in photogenerating layer 13 and positive charges or holes are injected into and transported through active layer 12 to selectively discharge the device, resulting in the formation of a latent electrostatic image on the surface of top layer 14. This image may then be developed in any conventional manner to form a visible image.

DESCRIPTION OF THE PREFERRED EMBODIMENTS

The following examples further specifically define the present invention with respect to a method of making a photosensitive member containing a photoconductive layer of trigonal selenium. The percentages are by weight unless otherwise indicated. The examples below are intended to illustrate various preferred embodiments of the present invention.

EXAMPLE I

An imaging member of the type illustrated in the drawing is made by the following method: A 3 mil aluminum substrate is coated with a 13 micron layer of poly-n-vinyl-carbazole from a 9 weight percent chloroform solution. A 0.25 micron layer of vitreous selenium is then formed over the PVK layer by conventional vacuum deposition techniques set forth by U.S. Pat. Nos. 2,753,278 and 2,970,906. The vacuum deposition is carried out at a vacuum of about $8 \times 10^{-6}$ Torr while the substrate is maintained at a temperature of about 50°C during the vacuum deposition. Following vacuum deposition, the imaging member is removed from the vacuum chamber and an approximately one micron thick layer of poly-n-vinylcarbazole formed over the top vitreous selenium layer. The purpose of the top layer of PVK is to prevent the loss of the selenium by evaporation during the subsequent thermal treatment. The structure is then heated to 125°C for 16 hours after which it is slowly cooled to room temperature. During this thermal treatment the vitreous selenium layer was converted to the crystalline trigonal form and the electrical properties measured. These properties are tabulated as follows:

at $\lambda = 5800A$ $$\text{Intensity} = 8 \times 10^{12} \frac{\text{photons}}{\text{cm}^2\text{-sec}}$$

$$\text{Photospeed} = 157 \frac{\text{volts}}{\text{cm}^2\text{-sec}}$$

$$\text{Dark Decay} = 2 \frac{\text{volts}}{\text{sec-}\mu}$$

$$\text{Initial Field} = 43 \frac{\text{volts}}{\mu}$$

From the xerographic properties illustrated above, the above device is suitable for use in xerographic imaging and is capable of forming a visible image.

In converting the vitreous selenium layer to a layer of crystalline trigonal selenium, the conversion may be carried out at any suitable elevated temperature for any length of time sufficient to cause the conversion. From a practical standpoint, however, the temperature must be sufficiently above room temperature in order for this transformation to be practically carried out in a reasonable time. It has been found that for a few minutes at 90°C, the combination of time and temperature were insufficient to completely transform the amorphous layer to the crystalline form. Further, as seen from the electrical data, samples generally display superior charge acceptance, dark decay, and photospeed values when heated at higher temperatures and/or for longer periods of time. For charge acceptance and photospeed values, these trends are generally more apparent in samples which are slowly cooled to room temperature after heating, than in samples cooled more rapidly. Therefore, it is preferred that the conversion of annealing temperature be at least 90°C for a time of at least 30 minutes. A preferred range for this conversion of amorphous selenium to the trigonal form would be a temperature range of about 125° to 210°C for a time ranging from about 1 to 24 hours. For samples heated for a time ranging from about 8 to 24 hours, the preferred cooling rate would be between about 1 and 5° per minute. Samples heated for a time ranging from about 1 hour to 8 hours can benefit from a more rapid cooling rate - particularly with respect to charge acceptance values. However, other combinations of time, temperature, and cooling rate can also give rise to good electrical properties. In general, trigonal selenium preparation below temperatures of about 125°C for times less than about 1 hour give rise to inferior xerographic properties.

Although specific components and proportions have been stated in the above description of the preferred embodiments of the present invention, other modifications and ramifications of the present invention would appear to those skilled in the art upon reading the disclosure. These also are intended to be covered in the scope of this invention.

What is claimed is:

1. A method of making a photosensitive imaging device which comprises;

a. forming a layer of electrically active organic material on a supporting substrate, (b) vacuum depositing a layer consisting essentially of vitreous selenium over said electrically active layer to a thickness of from 0.03 to 0.8 micron, (c) forming a relatively thin layer of electrically active or insulating organic material over said vitreous selenium layer, followed by (d) heating said device to a temperature in the range of 125° to 210°C for 1 to 24 hours to convert the vitreous selenium to the crystalline trigonal form.

2. The method of claim 1 in which the electrically active layers comprise a material selected from the group consisting of polyvinyl carbazole, polyvinyl pyrene, 2,4,7-trinitro-9-fluorenone, and mixtures thereof.

3. The method of claim 1 in which the relatively thin top layer comprises an electrically insulating resin.

4. An imaging device which comprises a supporting substrate having a layer of electrically active organic material overlaying said substrate, a layer of trigonal selenium about 0.03 to 0.8 microns thick overlaying said electrically active layer, and a relatively thin protective top layer of organic material overlaying said trigonal selenium layer.

5. The method of claim 1 wherein the electrically active organic material is carbazole, pyrene, tetra phenyl pyrene, benzochrysene, perylene, tetracene, pycene, fluorene, fluorenone or naphthalene.

* * * * *